US007597797B2

(12) United States Patent
Gregory

(10) Patent No.: US 7,597,797 B2
(45) Date of Patent: Oct. 6, 2009

(54) SYSTEM AND METHOD FOR ON-LINE SPALLING OF A COKER

(75) Inventor: Robert L. Gregory, League City, TX (US)

(73) Assignee: Alliance Process Partners, LLC, Houston, TX (US)

( * ) Notice: Subject to any disclaimer, the term of this patent is extended or adjusted under 35 U.S.C. 154(b) by 221 days.

(21) Appl. No.: 11/650,820

(22) Filed: Jan. 8, 2007

(65) Prior Publication Data

US 2007/0158240 A1 Jul. 12, 2007

Related U.S. Application Data

(60) Provisional application No. 60/757,461, filed on Jan. 9, 2006.

(51) Int. Cl.
*C10G 9/14* (2006.01)
*F28D 7/00* (2006.01)

(52) U.S. Cl. ..... 208/131; 208/48 R; 208/50; 208/132; 202/99; 420/34; 422/200; 427/250

(58) Field of Classification Search ..... 202/99; 420/34; 427/250; 422/200; 208/48 R, 50, 208/131, 132

See application file for complete search history.

(56) References Cited

U.S. PATENT DOCUMENTS 2,050,326 A 8/1936 Hopkins
2,179,774 A 11/1939 Zerbe
3,781,533 A 12/1973 Barnstone et al.
3,867,640 A 2/1975 Paulsen (Continued)

FOREIGN PATENT DOCUMENTS

CA 2003760 C 12/1990

(Continued)

OTHER PUBLICATIONS

Ellis, Paul J. et al., "Tutorial: Delayed Coking Fundamentals," presented at AIChE 1998 Spring National Meeting in New Orleans, LA. on Mar. 9, 1998, Topical Conference on Refinery Process, Tutorial Session on Delayed Coking, Paper 29a, Unpublished (20 pages), © 1998 Great Lakes Carbon Corporation.

(Continued)

*Primary Examiner*—Glenn Caldarola
*Assistant Examiner*—Prem C. Singh
(74) *Attorney, Agent, or Firm*—Strasburger & Price, LLP

(57) ABSTRACT

Coker heater operation is improved by on-line spalling of coker heater pipes. In one embodiment an off-line pipe is added to the on-line coker heater pipes. When an on-line pipe is to be spalled, flow is diverted to the off-line pipe allowing for full operation of the coker heater. In another embodiment, a thermal transfer resistant zone plate is movably mounted in the radiant section of the coker heater. By moving the zone plate from an operating position to a spalling position and adjusting the temperature of the plurality of burners, the temperature of the pipes in the zone of the heater radiant section to be spalled can be lowered, while the temperature in the remaining zones of the heater radiant section are fully operational.

22 Claims, 3 Drawing Sheets

U.S. PATENT DOCUMENTS

| | | | | |
|---|---|---|---|---|
| 4,243,630 | A | 1/1981 | Kliesch et al. | |
| 4,392,345 | A | 7/1983 | Geary, Jr. | |
| 4,557,804 | A | 12/1985 | Baumgartner et al. | |
| 4,667,731 | A | 5/1987 | Baumgartner et al. | |
| 4,732,737 | A | 3/1988 | Agarwal | |
| 4,899,899 | A | 2/1990 | Junier | |
| 5,290,431 | A | 3/1994 | Cunningham | |
| 5,707,923 | A | 1/1998 | Hutchens et al. | |
| 5,804,038 | A | 9/1998 | Nelson | |
| 6,013,172 | A | 1/2000 | Chang et al. | |
| 6,187,147 | B1 * | 2/2001 | Doerksen | 202/99 |
| 6,193,848 | B1 | 2/2001 | Shockley et al. | |
| 6,673,133 | B2 | 1/2004 | Sechrist et al. | |
| 6,797,026 | B2 | 9/2004 | Sechrist et al. | |
| 6,936,230 | B2 | 8/2005 | Zhurin et al. | |
| 2002/0157987 | A1 | 10/2002 | Schultz | |
| 2004/0099572 | A1 | 5/2004 | Evans | |
| 2007/0020154 | A1 | 1/2007 | Evans | |

FOREIGN PATENT DOCUMENTS

| | | | |
|---|---|---|---|
| GB | 2158933 | A | 11/1985 |
| GB | 2195424 | A | 4/1988 |
| GB | 2224561 | A | 5/1990 |
| GB | 2233405 | A | 1/1991 |
| IT | 01239142 | | 2/1990 |

OTHER PUBLICATIONS

Conticello, Richard et al., "Fired Heater Design & Decoking Techniques," presented at NPRA 2005 Q&A and Technology Forum, Principles & Practices Session, Crude/Vacuum Distillation & Coking, Unpublished (47 pages), Foster Wheeler.

FIG. 1 of present U.S. Appl. 11/650,820.

U.S. Provisional Appl. No. 60/757,461 by Robert L. Gregory.

Criterion Catalysts & Technologies, Technical Bulletin: Criterion Hydrotesting Catalyst Reactor Loading Guidelines, loading/8-98/1-12 (12 pages).

Freudenrich, Craig C. Ph.D., "How Oil Refining Works," http://www.howstuffworks.com, © 1998-2007 HowStuffWorks, Inc. (4 pages).

* cited by examiner

SYSTEM AND METHOD FOR ON-LINE SPALLING OF A COKER

CROSS-REFERENCE TO RELATED APPLICATIONS

This application claims the benefit of U.S. Provisional Application No. 60/757,461 filed on Jan. 9, 2006 and entitled "System and Method for Reducing the Cost of Operating a Coker/Heater". U.S. Provisional Application No. 60/757,461 is incorporated herein by reference in its entirety for all purposes.

STATEMENT REGARDING FEDERALLY SPONSORED RESEARCH OR DEVELOPMENT

The invention disclosed in this patent application is not the subject of federally sponsored research or development.

FIELD

This present invention pertains to a coker used in refineries for the processing of hydrocarbons. More particularly, the present invention pertains to an on-line spalling system for a coker heater and a method for use of the system.

BACKGROUND

Part of the process of refining crude oil into usable hydrocarbons involves separation of the denser materials from the lighter liquid hydrocarbons. The liquid hydrocarbons removed from the denser materials are further refined into gasoline and chemicals used for a variety of purposes in industry. The refining process involves heating the liquid hydrocarbons in successive steps to a temperature in which the desired hydrocarbon is vaporized. The vaporized hydrocarbon can be removed from the non-vaporized materials and collected in a separate vessel. Cooling of the vaporized hydrocarbon causes the vaporized hydrocarbon to return to the liquid form. Each hydrocarbon has a specific temperature at which it becomes a vapor. By heating the hydrocarbon-containing materials to a specific temperature, a specific product may be isolated and collected. Heating and reheating these hydrocarbon-containing materials to various temperatures eventually results in removal and collection of the valuable hydrocarbons which can then be used for a variety of purposes. Heating of the liquid hydrocarbon initially occurs in a coker heater. U.S. Pat. No. 5,804,038 and Patent Publication No. US 2002/0157987 A1 disclose exemplary coking systems and associated equipment including a coker heater or furnace. U.S. Pat. No. 5,804,038 and Patent Publication No. US 2002/0157987 A1 are incorporated herein by reference in their entirety for all purposes.

Coker heaters have been used to heat a fluid, such as a heavy cut of liquid hydrocarbons or crude oil, to temperatures approximately 920 degrees Fahrenheit (493 degrees centigrade) to facilitate thermal cracking and solid coke formation in the petroleum refining industry. These coke heaters are positioned in coke drum vessels used in the petroleum coking process. In the coking process, a layer of solid coke petroleum refining industry. These coke heaters are positioned in coke drum vessels used in the petroleum coking process. In the coking process, a layer of solid coke forms on the inside surface of the pipes or tubes positioned in a radiant section of the heater. The heater radiant section is where heat is transferred from a plurality of heater burners to the liquid hydrocarbons.

In some coker heaters two to four pipes are positioned in a horizontal orientation in the heater radiant section for passing or flowing liquid hydrocarbons. The horizontal pipes are heated by the burners so that the liquid hydrocarbons are heated in the pipes to about 920 degrees Fahrenheit (493 degrees centigrade). During this heating, coke is removed from the liquid hydrocarbons. Some of the coke that is removed from the liquid hydrocarbons is deposited on the inside of the pipes. Periodically, the deposited coke in the pipes must be cleaned out to restore the flow capacity of the pipes.

Cleaning of the pipes can be performed by one of two methods or both of the methods in combination. The first method of cleaning the deposited coke out of the pipes is called spalling. The second method of cleaning the deposited coke out of the pipes involves moving a mechanical pig through the pipes to mechanically scrape or remove the coke from the inside of each of the pipes. Spalling involves taking a coke-coated on-line pipe out-of-service so that it can cool. The pipes cool from about 1290 degrees Fahrenheit (700 degrees centigrade) to about 700 degrees Fahrenheit (371 degrees centigrade). During the cooling, some of the coke deposited on the inside of the on-line pipe breaks free or flakes off as the out-of-service pipe shrinks in size during cooling. The loose coke is then flushed out of the pipe, and collected in a tank, using boiler water or steam. The collected coke may be used as a fuel in other processes, as a hardener in the metallurgy industry or further fractionated to collect other valuable hydrocarbons. A typical spalling of a pipe takes about two days. During the time period when the on-line pipe is out-of-service no liquid hydrocarbons pass through the pipe so the overall flow capacity of the coker is reduced. For example, in a coker with four pipes passing through the heater radiant section, a throughput of about 10,000 barrels/day of liquid hydrocarbons through each pipe can be expected when the coker begins operation for a total design charge rate of 40,000 barrels/day. If one pipe is taken off-line or is out-of-service for spalling for two days, there is a 20,000 barrel loss of throughput for the two days. Depending on the chemical characteristics of the crude oil processed by the coker heater, spalling of the pipes in the coker heater occur every two to nine months.

Because spalling does not completely clean out the pipes running through a coker, many refinery operators use a mechanical pig to clean out all of the pipes about every eight to ten months. In "pigging", a foam or plastic pig with metal studs and grit could be passed through the on-line pipe. As it is passed through the pipe the pig rotates and scrapes the coke off of the inside of the pipe. During the process "pigs" of different sizes and abrasiveness can be used to remove most all of the coke on the inside of the pipe. Typically, the mechanical pigging takes about five days. During this five-day period, there is no throughput of liquid hydrocarbons through the coker. Further, "pigging" is usually performed by an outside vendor resulting in additional cost to the refinery operator.

Thus, because of the need to remove deposited coke from the pipes, a refinery operator loses the profit that can be made processing liquid hydrocarbons each time the two day spalling is performed in addition to the loss of profit when the coker is completely off-line for the five day mechanical pigging.

Those of ordinary skill in chemical process plant engineering also understand that the refinery operator suffers other losses from the coke deposited on the inside of the pipes. Specifically, if all of the coke inside the pipes is not removed by spalling, the coke which remains inside of the pipes after spalling restricts the size of the opening through which the liquid hydrocarbons may pass thereby reducing the throughput of liquid hydrocarbons.

Additional losses occur as the coke deposited on the inside of the pipes acts as a heat insulator. The outer skin temperature of a clean pipe passing through the heater radiant section may only need to be 930 degrees Fahrenheit (510 degrees centigrade) to heat the liquid hydrocarbons to 920 degrees Fahrenheit (493 degrees centigrade). However, as the coke builds up on the inside of the pipe, the skin temperature needed on the outside of the pipe to heat the liquid hydrocarbons in the pipe to 920 degrees Fahrenheit (493 degrees centigrade) may increase the needed pipe skin temperature to be as much as 1250 degrees Fahrenheit (677 degrees centigrade). Two consequences are associated with higher skin temperatures on the outside of the pipe. First, more energy is needed to achieve these higher pipe skin temperatures and, second, the service life of the pipe is decreased when it must be maintained at higher temperatures for longer periods of time. The increased energy and the decreased life span of the pipe increases the cost to the refinery operator for refining liquid hydrocarbons. Inevitably, that cost must be passed along to the consumer.

Accordingly, it would be desirable to provide an on-line spalling system and method that reduces the cost of operating a coker.

SUMMARY

The on-line spalling system and method of the present invention reduces the cost of operating a coker.

In one embodiment of the present invention, an off-line pipe and associated valving system is used for throughput of liquid hydrocarbons when one of the plurality of on-line pipes passing through the coker is out-of-service for spalling. Thus, during the spalling, there is no reduction in throughput of liquid hydrocarbons as the throughput capacity lost during the spalling of one of the plurality of pipes is taken up by the additional off-line pipe. When the spalling of one of the pipes in the plurality of on-line pipes is completed, another on-line pipe is selected for spalling with the liquid hydrocarbons continued to be passed through the additional off-line pipe while the spalling is underway.

Those familiar with refinery operations will see the advantages of passing the liquid hydrocarbons through an additional off-line pipe during the spalling of one of the plurality of on-line pipes. First, there is no reduction in throughput through the coker while spalling is taking place. Second, this additional pipe would make more frequent spalling attractive. More frequent spalling reduces the amount of deposited coke inside the plurality of pipes. A reduction in the amount of coke inside the plurality of on-line pipes provides more area through which the liquid hydrocarbons can flow, thus resulting in an overall increase in throughput of liquid hydrocarbons through the coker. Second, a reduction in the amount of coke inside the plurality of on-line pipes reduces the amount of heat needed to raise the skin temperature of the pipes thereby reducing energy cost. Third, because the on-line pipes need not be heated to as high skin temperatures, the service life of the pipes is increased. It has been observed that pipes which have not been subjected to elevated skin temperature may have a useful lifespan of about 20 years. Those pipes which have been repeatedly subjected to elevated skin temperature tend to fail after 4 years of use. Replacing a failed pipe is expensive. The pipe itself costs several million dollars and the coker must be completely shut down for an extended period of time to effect repairs. All of these factors contribute to more economical operation of a coker in the refining of liquid hydrocarbons.

In another embodiment of the present invention, at least one movable thermal transfer resistant zone plate is pivotably positioned inside the radiant section of a coker heater to define at least two zones in the coker heater radiant section. The temperature of the burners in the heater are remotely set so that one zone of the radiant section can continue processing fluids, such as liquid hydrocarbons, through pipes in that zone while the temperature in the other zone containing pipes to be spalled can be lowered.

Those familiar with refinery operations will also see the advantages of radiant section temperature zones in a coker heater during the spalling of one of the plurality of on-line pipes. First, there is limited reduction in throughput through the coker heater while spalling is taking place. Second, this temperature zoned coker heater would make more frequent spalling attractive. More frequent spalling reduces the amount of deposited coke inside the plurality of on-line pipes. A reduction in the amount of coke inside the plurality of on-line pipes provides more area through which the liquid hydrocarbons can flow, thus resulting in an overall increase in throughput of liquid hydrocarbons through the coker. Second, a reduction in the amount of coke inside the plurality of on-line pipes reduces the amount of heat needed to raise the skin temperature of the pipes thereby reducing energy cost. Third, because the pipes need not be heated to as high skin temperatures, the service life of the pipes is increased. All of these factors contribute to more economical operation of a coker in the refining of liquid hydrocarbons.

BRIEF DESCRIPTION OF THE FIGURES

A better understanding of the system and method disclosed herein may be had by examination of the figures wherein.

DESCRIPTION OF THE EMBODIMENTS

Figure 1:
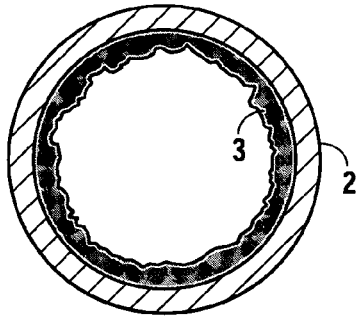
Fig. 1 (PRIOR ART)
FIG. 1 shows a cross section of a pipe from a radiant section of a coker heater with deposits of coke inside the pipe.

FIG. 1 is a cross section of a typical pipe 2 positioned in a radiant section of a coker heater. The heater burners (not shown) in the radiant section, generally indicated as 9, heat the hydrocarbon-containing material to approximately 920 degrees Fahrenheit (493 degrees centigrade). At this temperature, the liquid hydrocarbons are vaporized for later isolation and collection. What remains on the inside of the pipe 2 are the solid materials, such as coke 3. In many coker heaters presently in use, the inside diameter of the pipe 2 begins at about 4 inches. As liquid hydrocarbons are heated and run through each pipe 2, coke 3 is deposited on the inside of the pipe 2 thus reducing the internal flow area and insulating the center portion of the pipe 2 through which the liquid hydrocarbons flow. As the coke 3 builds up the flow of liquid hydrocarbons is reduced or limited. At a certain point the pipe 2 must be serviced so that the coke 3 buildup can be removed, either in whole or in part, so that efficient and acceptable throughput of liquid hydrocarbons can be achieved.

A portion of the coke 3 formed on the inside of the pipe 2 shown in FIG. 1 is removed by spalling or cooling the pipe so that as it cools the pipe contracts causing some of the coke 3 deposited on the inside of the pipe 2 to fragment, chip, crack, flake and/or break off. The coke 3 which breaks off due to the cooling of the pipe is removed from the pipe by a steam or boiler water spray. The removed coke 3 is then refined into other usable products. However, the spalling, which takes about two days per pipe typically, does not remove all of the deposited coke 3 so about every eight to ten months, in most refineries, the entire coker is taken off line for mechanical pigging of the pipes to remove all deposited coke 3. This mechanical pigging takes about five days.

Figure 2:
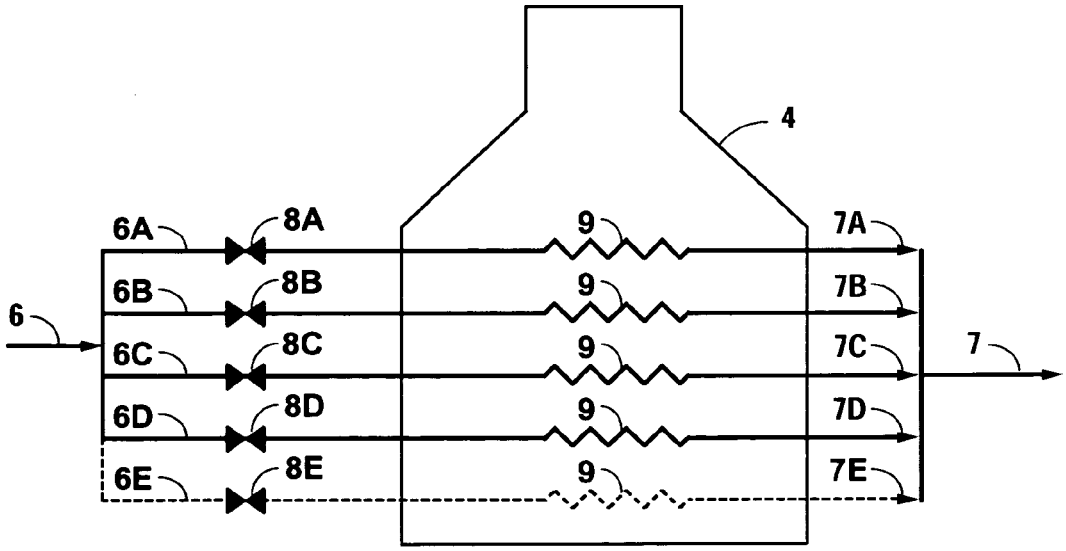
FIG. 2 shows one embodiment of a coker heater with the addition of an off-line pipe, schematically illustrated in dashed lines, for use when one of the on-line pipes is out-of-service for spalling.

Turning now to FIG. 2, a coker heater 4 consists of four on-line pipes 6A, 6B, 6C and 6D through which liquid hydrocarbons are pumped and heated to the desired temperature. In one embodiment of the system and method of the present invention, an off-line or fifth pipe 6E is added to the coker heater 4 with the four pipes 6A, 6B, 6C and 6D. The liquid hydrocarbon is pumped into the on-line pipes 6A, 6B, 6C and 6D at the influent side 6 of the coker heater 4 and liquid hydrocarbon with the coke removed is passed out the effluent side 7 of the coker heater 4 through the effluent ends 7A, 7B, 7C and 7D of respective on-line pipes 6A, 6B, 6C and 6D. As the liquid hydrocarbon is pumped through the on-line pipes 6A, 6B, 6C and 6D, the liquid hydrocarbon is heated in the radiant section 9. Using a valving system having a plurality of valves 8A, 8B, 8C, 8D and 8E operably positioned at the respective pipe influent ends of pipes 6A, 6B, 6C, 6D and 6E, the respective pipes 6A, 6B, 6C, 6D and 6E can be opened or closed. In this maimer one of the on-line pipes 6A, 6B, 6C or 6D can be closed for spalling and the overall desired throughput maintained by opening valve 8E to the influent end of pipe 6E to divert the liquid hydrocarbon through the off-line pipe 6E and out its effluent end 7E. When the time comes to remove some of the deposited coke, similar to deposited coke 3 in FIG. 1, in one of the on-line pipes 6A, 6B, 6C or 6D, the respective valve 8A, 8B, 8C or 8D is closed, preventing flow of the liquid hydrocarbon to the respective pipe to be spalled and the valve 8E is opened to divert flow to the off-line pipe 6E. The result is that there is no reduction in the throughput of the liquid hydrocarbons through the coker heater 4. Thus all losses of operating profit due to a decrease in the ability to refine liquid hydrocarbons during spalling of the heater pipes is reduced. When the spalling of one pipe is complete, the other valves in the on-line pipes can be closed one at a time (or multiple valves could be closed if desired) and the flow of liquid hydrocarbons continued to be run through the off-line pipe 6E.

In view of the above advantages, the spalling method can be run more frequently than with known methods. Accordingly, there is less build up of deposited coke 3 within the on-line pipes 6A, 6B, 6C and 6D. The effect of having less build up of deposited coke 3 inside the pipes has a two-fold effect. First, the throughput capacity or effluent of liquid hydrocarbons remains at a higher level. Second, the effect of having less build up of deposited coke 3 reduces the amount of energy needed to raise the skin temperature of each of the pipes 6A, 6B, 6C and/or 6D to a level where the temperature of the liquid hydrocarbons in the radiant section 9 of the coker heater 4 remains at 920 degrees Fahrenheit (493 degrees centigrade).

Figure 3:
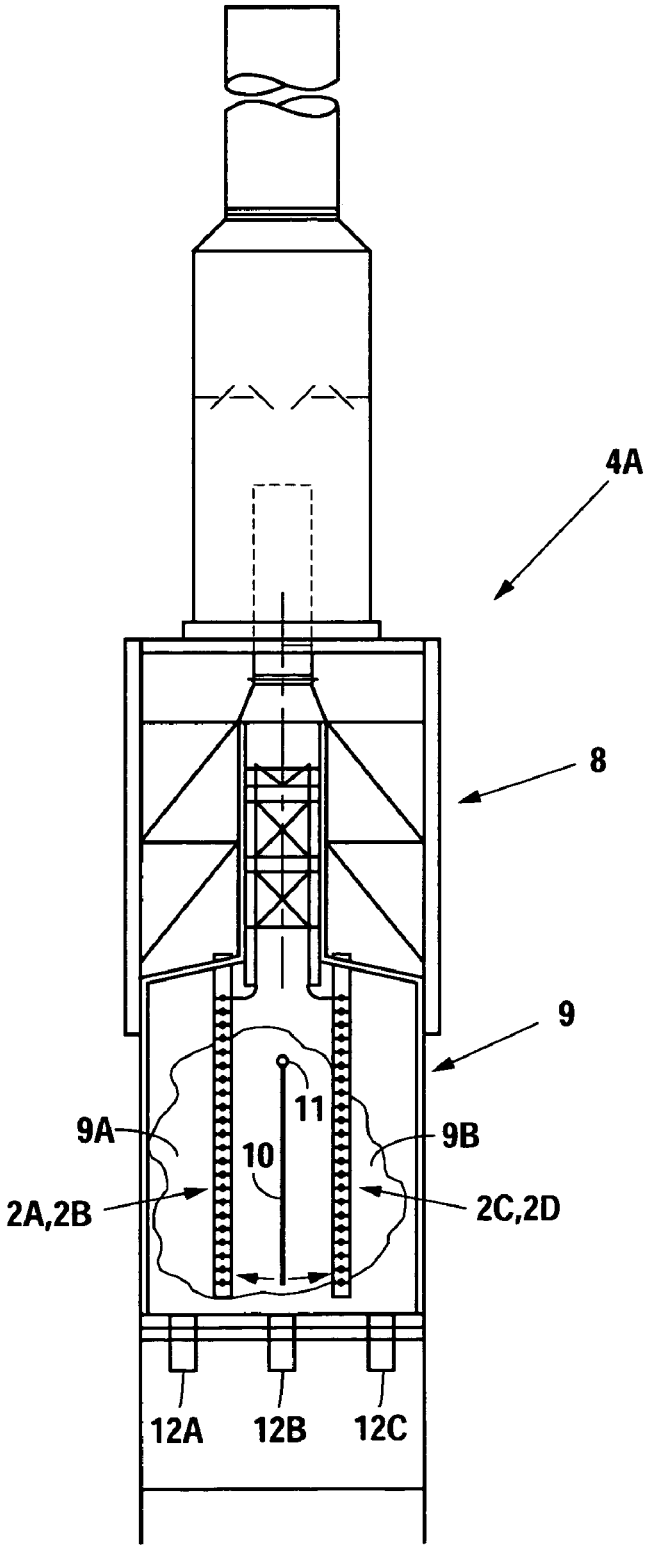
FIG. 3 is a side view of another embodiment of a coker heater with a thermal transfer resistant zone plate in an operating position for full operation of the coker heater.
Figure 4:
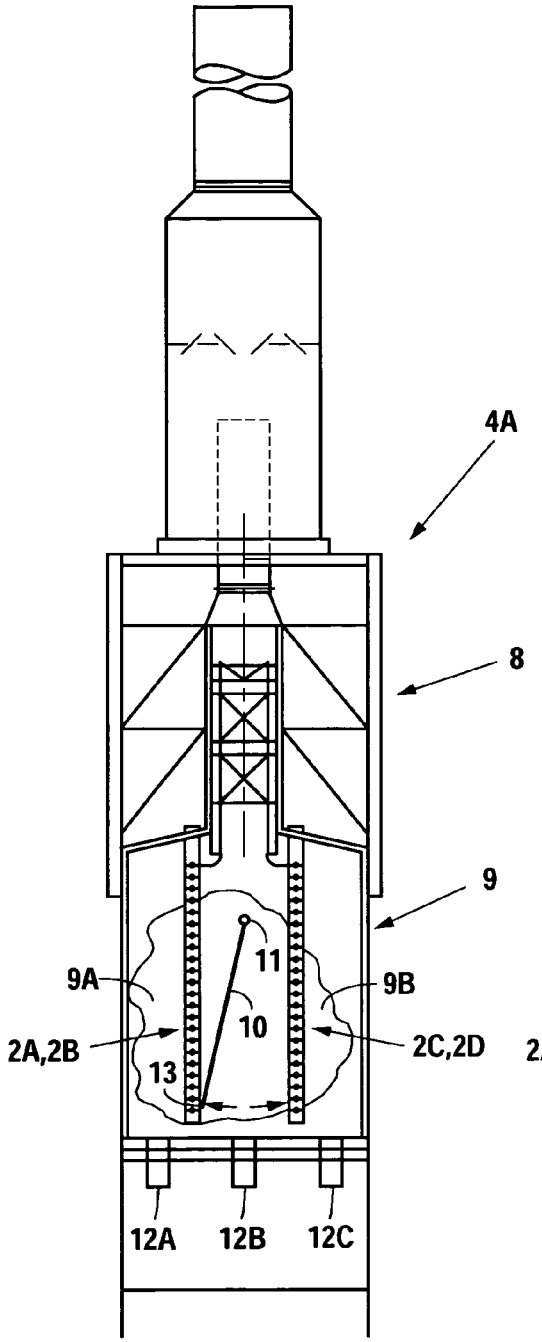
FIG. 4 is a side view, similar to FIG. 3, with the thermal transfer resistant zone plate in a first spalling position for spalling of one zone of the coker heater.
Figure 5:
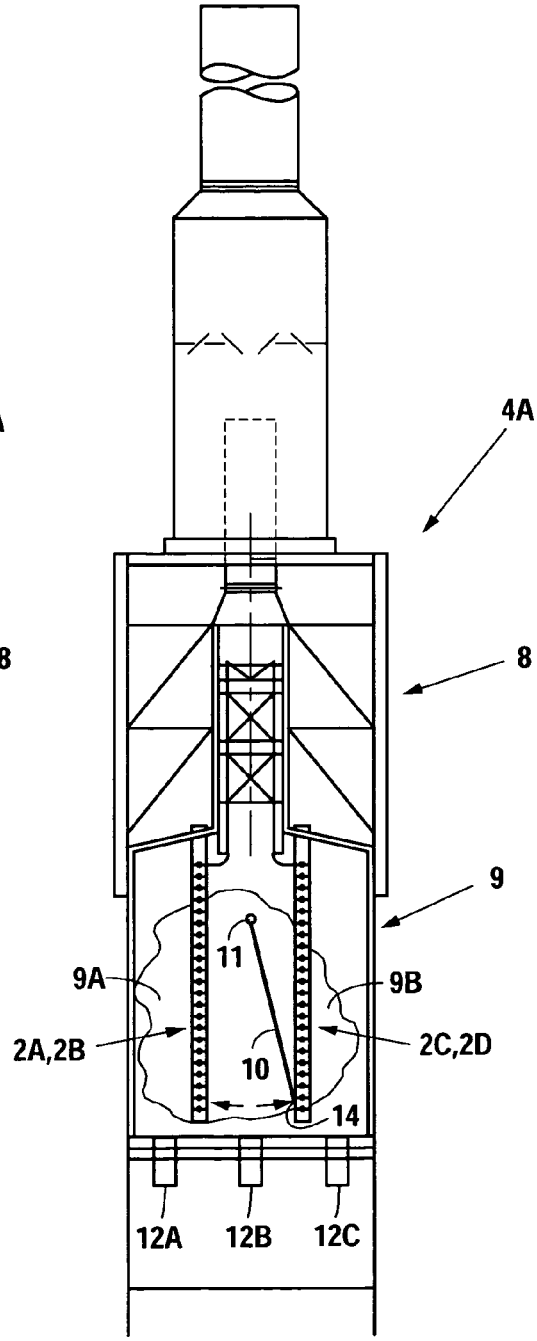
FIG. 5 is a side view, similar to FIG. 3, with the thermal transfer resistant zone plate in a second spalling position for spalling of the other zone of the coker heater.

Another embodiment of the system and method for on-line spalling is shown in FIGS. 3, 4 and 5. In this embodiment the coker heater 4A is constructed with a thermal transfer resistant zone plate 10. In particular, a horizontal dual-fired, two pass coker heater 4A is fabricated or retrofitted with the zone plate 10 positioned lengthwise in the radiant section 9. The zone plate 10 diverts and insulates by creating a barrier to the heat from the burners 12A, 12B and 12C. Moving the zone plate 10 allows some of the pipe(s) to stay in operation while the other pipe(s) are spalled. Using this coker heater 4A, pipes can be spalled without a complete shut down of the heater 4A, resulting in the retention of about at least 50 percent of the design charge rate. This two zone configuration, as shown in FIGS. 3, 4 and 5, allows spalling to be completed at 75% of the design charge rate. It is contemplated that the zone plate 10 could be supported by pedestals at each end of the heater firebox and remotely pivoted by a motor/gear driven mechanism. In the illustrated embodiment, the radiant section 9 is located below the convection section 8 with plate 10 spanning about two-thirds of the height of the radiant section 9 with the lower end of the plate 10 is positioned about 2 to 3 feet over the center burner 12B. The thermal transfer resistant zone plate 10 may be fabricated from 9 chrome, refractory-covered carbon steel or other heat resistant material. While the plate 10 is illustrated to pivot about axis 11, one of ordinary skill in the art would understand that the present invention is directed to creating temperature zones in a radiant section of a coker heater so that the temperature in one radiant section zone of the coker heater 4A can be reduced for spalling while another radiant section zone(s) of the coker heater 4A are operational. In other words, the temperature in the zone of the coker heater 4A radiant section 9 containing the pipe(s) to be spalled can be reduced or lowered sufficiently to permit spalling of the coke 3. It is also contemplated that three or more zones could be created using multiple movable zone plates so that the burners in the zone of the coker heater to be spalled is reduced while the remaining burners are set to provide the desired temperature to the remaining zones permitting continuous operation of the pipes in the heated zones.

FIG. 3 shows the thermal transfer resistant zone plate 10 in an operational position for full operation of the pipes 2A, 2B, 2C and 2D in the coker heater 4A. FIG. 4 shows one end of the thermal transfer resistant zone plate 10 pivoted about the axis 11 and locked in a first spalling position 13 to insulate and divert heat from zone 9A of the coker heater 4A for spalling of pipes 2A and 2B of the coker heater 4A. Operation of pipes 2C and 2D in zone 9B of the coker heater 4A therefore continues unabated.

FIG. 5 shows the thermal transfer resistant zone plate 10 pivoted about the axis 11 and locked in a second spalling position 14 to insulate and divert heat from the zone 9B of the coker heater 4A for spalling of pipes 2C and 2D of the coker heater 4A. Operation of the pipes 2A and 2B in zone 9A of the coker heater 4A therefore continues unabated. As discussed above, this radiant section temperature zoning of the present invention minimizes the losses of liquid hydrocarbon refining while encouraging frequent spalling of the pipes. Frequent spalling improves overall productivity of the refining process and extends the useful life span of the pipe.

Those of ordinary skill in the art of building, operating and maintaining cokers will understand that a reduction in the amount of deposited coke build up inside a pipe will reduce the overall needed skin temperature of the pipe and thereby increase the service life of the pipe. However, using the system and method of the present invention, the periods between mechanical pigging of the pipes can be made longer thus further reducing the cost of operating the coker. Those of ordinary skill in the art will also recognize that there are other embodiments of the invention described in this application which are not specifically disclosed. Those other embodiments are included within the scope and meaning of the appended claims.

What is claimed is:

1. A method for on-line spalling of a pipe adapted for use with a coker heater comprising the steps of:

flowing a liquid hydrocarbon through a plurality of on-line pipes in the coker heater; and diverting said liquid hydrocarbon through an off-line pipe positioned in the coker heater while one of said plurality of on-line pipes in the coker heater is being spalled.

2. A method for on-line spalling of a pipe adapted for use with a coker heater comprising the steps of:

positioning a zone plate in a radiant section of the coker heater;

moving said zone plate from an operating position to a spalling position;

reducing a temperature to a zone defined by said zone plate for the pipe to be spalled to a reduced temperature; and maintaining a desired temperature in the other zone of said radiant section defined by said zone plate for another pipe.

3. The method of claim 2, further comprising the step of: spalling the pipe in the reduced temperature zone.

4. The method of claim 2 wherein the step of reducing the temperature comprises lowering the heat transferred from a burner positioned below the reduced temperature zone.

5. The method of claim 2 wherein said zone plate spans approximately two-thirds a height of said radiant section of the coker heater.

6. The method of claim 2 wherein said radiant section of the coker heater comprises at least three burners.

7. The method of claim 6 wherein said zone plate is pivoted so that one end of said zone plate moves from above a burner positioned between the other burners to a position where said end of the zone plate is above the burners with one burner on one side of said end of said zone plate and two burners on the other side of said end of said zone plate.

8. The method of claim 7 wherein the burner on one side of said pivoted zone plate is turned off.

9. The method of claim 8 wherein said zone plate can be pivoted and locked and the burner on said one side of said pivoted zone plate can be operated from a remote location.

10. A method for on-line spalling of a pipe adapted for use with a coker heater comprising the steps of:

flowing a hydrocarbon through a plurality of on-line pipes in the coker heater;

moving a first valve to a closed position for controlling the flow of said hydrocarbon to one of said plurality of on-line pipes; and diverting said hydrocarbon through an off-line pipe positioned in the coker heater while one of said plurality of on-line pipes in the coker heater is being spalled.

11. The method of claim 10, further comprising the step of: moving a second valve to an open position for allowing the flow of said hydrocarbon to said off-line pipe.

12. A method for on-line spalling of a pipe adapted for use with a coker heater comprising the steps of:

positioning a zone plate in the coker heater;

moving said zone plate from an operating position to a spalling position;

adjusting a temperature to a zone defined by said zone plate for the pipe to be spalled to an adjusted temperature; and providing a desired temperature in another zone of the coker heater defined by said zone plate for another pipe.

13. The method of claim 12, further comprising the step of: spalling the pipe in the adjusted temperature zone.

14. The method of claim 12 wherein the step of adjusting the temperature comprises lowering the heat transferred from a burner positioned adjacent the adjusted temperature zone.

15. The method of claim 12 further comprising a radiant section in the coker heater, wherein said zone plate spans approximately two-thirds a height of said radiant section of the coker heater.

16. The method of claim 12 further comprising a radiant section in the coker heater, wherein said radiant section of the coker heater comprises at least three burners.

17. The method of claim 16 wherein said zone plate is pivoted so that one end of said zone plate moves from above a burner positioned between the other burners to a position where said end of said zone plate is above the burners with one burner on one side of said end of said zone plate and two burners on the other side of said end of said zone plate.

18. The method of claim 17 wherein the burner on one side of said pivoted zone plate is turned off.

19. The method of claim 18 wherein said zone plate can be pivoted and locked and the burners on said one side of said pivoted zone plate can be operated from a remote location.

20. The method of claim 12 wherein said zone plate is fabricated from chrome.

21. A method for on-line spalling of a pipe adapted for use with a coker heater comprising the steps of:

positioning a zone plate in the coker heater;

moving said zone plate from an operating position to a spalling position defining a zone for the pipe to be spalled; and providing a desired temperature in another zone of the coker heater defined by said zone plate for another pipe.

22. The method of claim 21, further comprising the step of: adjusting a temperature in the zone defined for the pipe to be spalled.

* * * * *